US006424304B1

(12) United States Patent
Jan et al.

(10) Patent No.: US 6,424,304 B1
(45) Date of Patent: Jul. 23, 2002

(54) ANTENNA APPARATUS

(75) Inventors: Cheng-Geng Jan, Hsin-Chu Hsien; Wei-Li Cheng, Taipei; Chien-Hsing Fang, Taichung Shien, all of (TW)

(73) Assignee: Acer NeWeb Corp. (TW)

( * ) Notice: Subject to any disclaimer, the term of this patent is extended or adjusted under 35 U.S.C. 154(b) by 0 days.

(21) Appl. No.: 09/877,100

(22) Filed: Jun. 11, 2001

(51) Int. Cl.[7] ..... H01Q 1/24
(52) U.S. Cl. ..... 343/702; 343/860; 343/700 MS
(58) Field of Search ..... 343/700 MS, 702, 343/725, 846, 850, 852, 853, 860, 861, 893

(56) References Cited

U.S. PATENT DOCUMENTS 4,803,491 A * 2/1989 Hikuma ..... 343/702
5,550,554 A * 8/1996 Erkocevic ..... 343/702
6,252,561 B1 * 6/2001 Wu et al. ..... 343/741
6,295,030 B1 * 9/2001 Kozakai et al. ..... 343/700 MS
6,339,400 B1 * 1/2002 Flint et al. ..... 343/702
6,348,893 B1 * 2/2002 Herranen et al. ..... 343/702

* cited by examiner

*Primary Examiner*—Don Wong
*Assistant Examiner*—Shih-Zhao Chen
(74) *Attorney, Agent, or Firm*—Michael D. Bednarek; Shaw Pittman LLP

(57) ABSTRACT

An antenna apparatus for providing wireless communication comprise a first antenna plate, a second antenna plate and a matched circuit. The matched circuit has a front line and a transferring line so as to be formed as an appropriate impedance between the first antenna plate and the second antenna plate, wherein one end of the transferring line is coupled to the front line forming a T shaped converging portion having a first feedback point and a second feedback point. The first antenna plate has an electrical foot connecting to the first feedback point and a ground foot connecting to the ground. Similarly, the second antenna plate has an electrical foot connecting to the second feedback point and a ground foot connecting to the ground.

20 Claims, 6 Drawing Sheets

ANTENNA APPARATUS

BACKGROUND OF THE INVENTION

1. Field of the Invention

The present invention relates an antenna apparatus, and especially relates for an antenna apparatus having the vertically and horizontally omni-directional radiation pattern so as to improve the quality of the transmitted signal of the antenna.

2. Description of the Related Art

A local area network (LAN) means that several computers are connected each other in a specified area. For instance, two or more computers have working stations installed thereon and are connected through cable or wireless communication. Therefore, computers in the LAN can share and transmit data.

Most computers recently are connected through cables. However, the following defects will be occurred because of using cables to form the LAN. Firstly, it is difficult and expensive to change the location of the client computer after completely installation of the network. Second of all, the cable should be added or removed if new client computer have been changed. This would be heavy work for the network provider. Thirdly, a cable network installation may have a great influence on the view of the building. Furthermore, the cable network installation is not so flexible in arrangement.

For stated above, wireless LAN technology is increasingly developed and it is intend to replace the cable network installation. There is many communication manufactories, i.e. IBM, Ericsson, Mobile Communications, Nokia, Toshiba and Intel Corp., develops a Bluetooth protocol for the wireless communication within a short distance about 150 meters.

Please refer to FIG. 1, which shows a circuit diagram of a wireless network device. The circuit diagram comprises an antenna apparatus 10, a RF unit 12 and a DSP unit 14 wherein the RF unit 12 has a low noise amplifier (LNA) 121, a power amplifier (PA) 123 and a mixer 125. The antenna apparatus 10 is used for receiving and transmitting signal. When the antenna apparatus 10 receiving the signal, it is processed with the filter by the power amplifier 123 and the descending frequency by the mixer 125 such that the DSP unit 14 can be used for decoding radio frequency signal. On the other hand, when the signal is transmitted through the antenna apparatus 10, it is coding by the DSP unit 14 and the signal is processed with the filter by the power amplifier 123 and the rising frequency by the mixer 125.

When transmitting the signal, the important component is the antenna and the quality of the communication, the range of the communicating and the transmitting rate are dependent on the performance of the antenna. As the allocation of the client computer is flexible, especially for the portable computer users, it is hard to predict the using condition of the client computer. Therefore, the requirement of the antenna is to receive or transmit the signal without the direction limit. That is, an omni-directional radiation pattern of antenna is required for using in the wireless communication.

Referring to FIG. 2, a conventional wireless device such as a rod antenna 22 is shown. The position of the rod antenna 22 should be perpendicular to one horizontal surface if a horizontally omni-directional radiation pattern is required. However, such installation will cause a bad vertical radiation pattern performance. On the other hand, the position of the rod antenna 22 should be perpendicular parallel to one horizontal surface if a vertical omni-directional radiation pattern is required. However, such installation will cause a bad horizontal radiation pattern performance. For stated above, it is hard to find an installation of the rod antenna 22 that the vertically and horizontally omni-directional radiation pattern be achieved.

The conventional wireless apparatus for using the rod antenna comprises the following shortcomings. The rod antenna is installed for external application and the performance of the rod antenna depends of the length and the height thereof. However, the increasing size of the rod antenna causes inconvenience to users and such product may not be competitive with other similar product. Finally, the external antenna usually is made by manufacturers rather than the system manufacture such that the total cost of the system will be increased.

Therefore, it is necessary to develop a low cost and small size antenna with high transmitting performance for wireless network manufacturers. Furthermore, an antenna apparatus having the vertically and horizontally omni-directional radiation pattern is developed by the applicant and it can be received within the computer system.

SUMMARY OF THE INVENTION

Therefore, it is an objective of the present invention to provide an antenna apparatus for providing the vertically and horizontally omni-directional radiation pattern.

Another object of the present invention is to provide an antenna apparatus with a simple structure so as to lower the cost of the antenna and to easily be made.

Another object of the present invention is to provide a small volume of an antenna apparatus so as to be received within the wireless card.

The antenna apparatus of this invention is utilized in the wireless communication and comprises a first antenna plate, a second antenna plate and a matched circuit. The matched circuit has a front line and a transferring line so as to be formed as an appropriate impedance between the first antenna plate and the second antenna plate, wherein one end of the transferring line is coupled to the front line forming a T shaped converging portion having a first feedback point and a second feedback point. The first antenna plate has an electrical foot connecting to the first feedback point and a ground foot connecting to the ground. Similarly, the second antenna plate has an electrical foot connecting to the second feedback point and a ground foot connecting to the ground.

The first antenna plate and the second antenna plate are L shaped metal plates and are arranged symmetrically to form the like of an annulus rectangular so that a horizontally omni-directional radiation pattern can be accomplished. Furthermore, the antenna plates and the feet thereof form an inversed F shape and a specific height of the antenna apparatus can be maintained so that a vertically omni-directional radiation pattern can be accomplished. Therefore, the antenna apparatus of the present invention can provide the vertically and horizontally omni-directional radiation pattern so as to improve the quality of the transmitted signal of the antenna.

BRIEF DESCRIPTION OF DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE INVENTION

The antenna apparatus of this invention is utilized in the wireless LAN card, wherein the transmitted and received signal method is described in the description of the related art.

Figure 1:
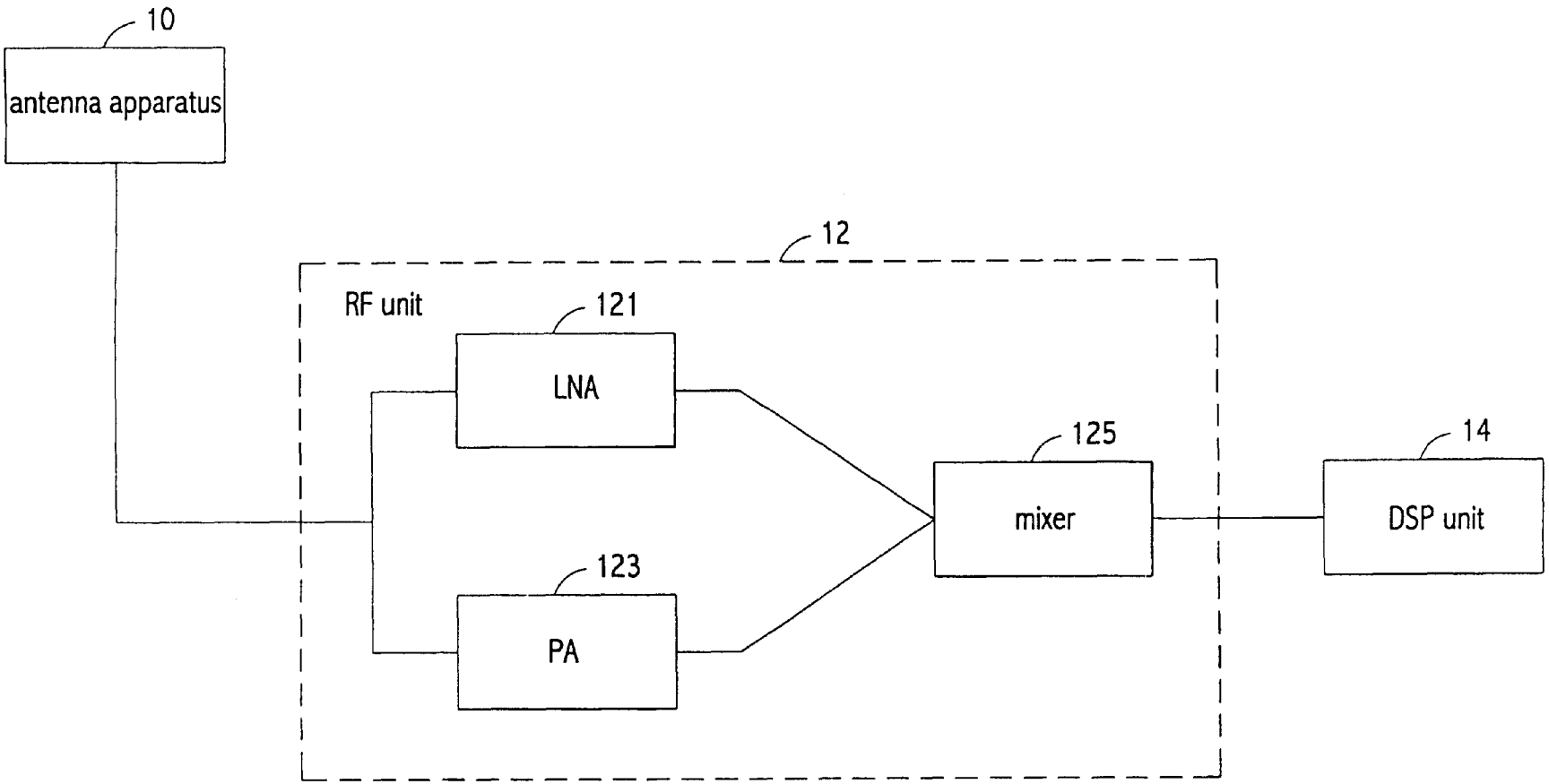
FIG. 1 schematically depicts a circuit diagram of a wireless network card.
Figure 2:
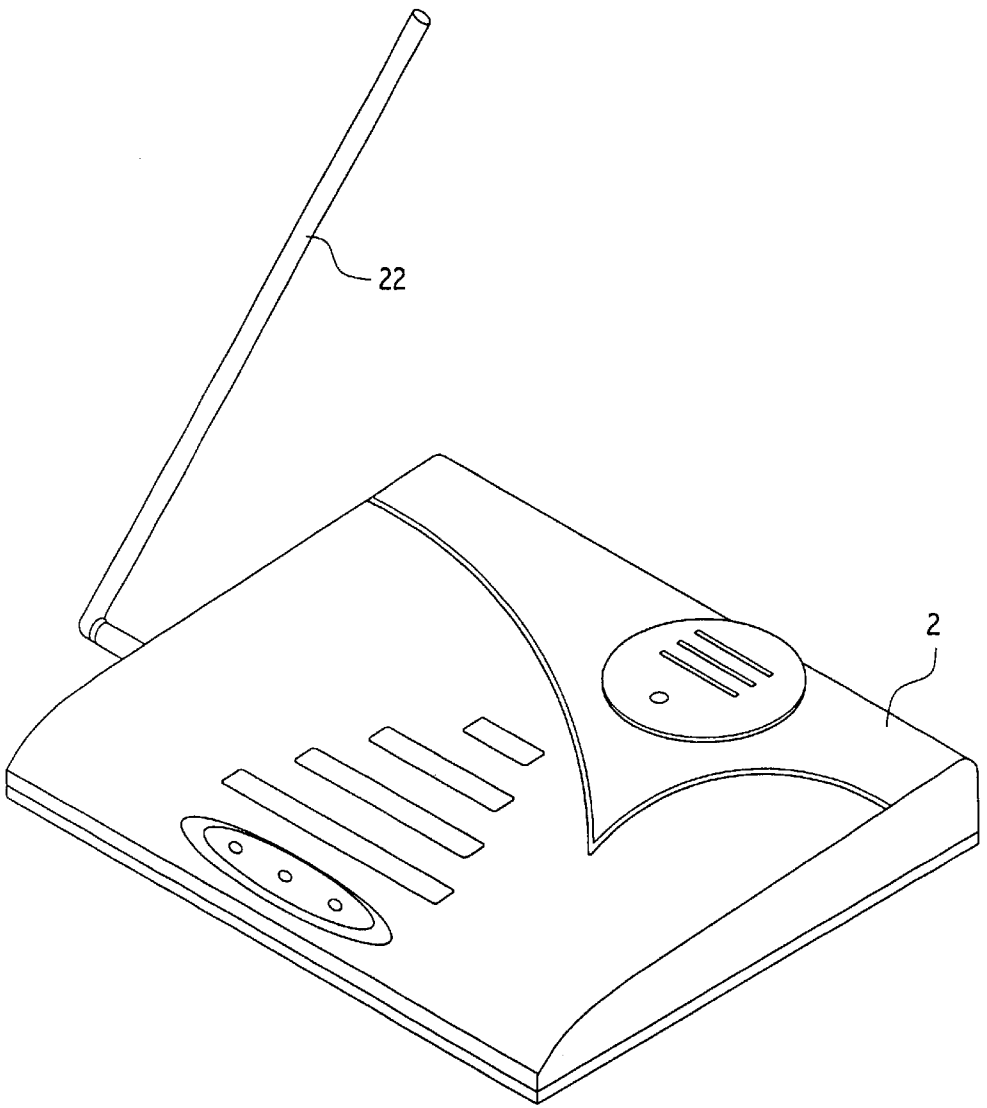
FIG. 2 schematically depicts a conventional wireless network card.
Figure 3:
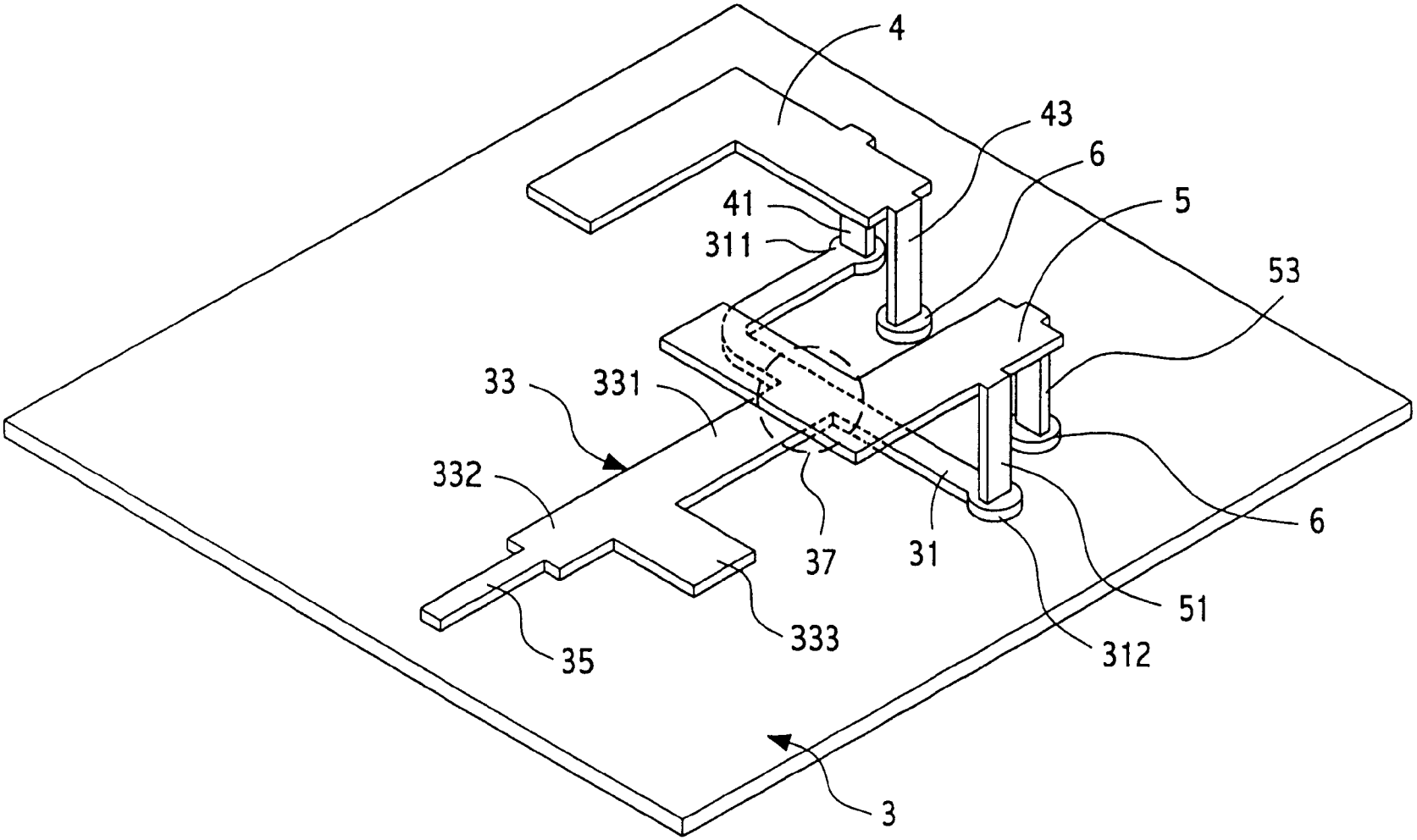
FIG. 3 schematically depicts a perspective view of the antenna apparatus of the present invention.

Referring to FIG. 3, the antenna apparatus comprises a matched circuit 3, a first antenna plate 4, and a second antenna plate 5. The matched circuit 3 has a front line 31, a transferring line 33 and a rear line 35. The transferring line 33 comprises a first end 331 and a second 332, wherein the first end 331 is coupled to an appropriate position of the front line 31 and then forms a T shaped converging portion 37. The width of the transferring line 33 is large than that of the front line 31 such that the transferring line 33 has a transformer function to be formed the appropriate impedance. The length of the transferring line 33 can be selected as a quarter of the wavelength. A sub-line 333 is formed on the transferring line 33 so that the impedance is changed and the frequency of the signal on the transferring line 33 can fine tune. The font line 31 has a first feedback point 311 and a second feedback point 312 forming both ends thereof for receiving signals from the first antenna plate 4 and the second antenna plate 5 respectively. The impedance of the front line 31 is preferable 50 ohms for obtaining a better transmission when transmitting the signal from the antenna. The second end 332 is connected to the transferring line 33 wherein the impedance of the rear line 35 is preferable 50 ohms and the width thereof is the same as that of the front line 31 so that an appropriate impedance between the transferring line 33 and the second end 332 can be obtained for obtaining a better transmission when transmitting the signal from the antenna. The rear line 35 is connected to a signal line for transmitting the signal to the RF unit 12 and the DSP unit 14. The matched circuit 3 can be formed on a print circuit board.

The first antenna plate 4 is made of an L shaped metal plate and has an electrical foot 41 and a ground foot 43 which are perpendicular to the L shaped metal plate. The electrical foot 41 is connected to the first feedback point 311 and the ground foot 43 is connected to the ground line 6.

The second antenna plate 5 is made of an L shaped metal plate and has an electrical foot 51 and a ground foot 53 which are perpendicular to the L shaped metal plate. The electrical foot 51 is connected to the second feedback point 312 and the ground foot 53 is connected to the ground line 6. The first antenna plate 4 and the second antenna plate 5 are arranged symmetrically to form the like of an annulus rectangular. Furthermore, the antenna plate and the feet thereof form an inversed F shape and a specific height of the antenna apparatus can be maintained.

When the first antenna 4 and the second antenna 5 receive the signal, the signal passes through the electrical feet 41, 51 and is input into the front line 31 through the feedback points 311, 312. The signal from the two ends of the font line 31 is converged to the T shaped converging portion 37. The signal can be completely transmitted to the transferring line 33 because of the matched impedance between the front line 31 and the transferring line 33. When transmitting the signal on the transferring line 33, the frequency or the impedance of the signal can be fine tuned by the sub-line 333 so as to prevent the return loss. The signal is then transmitted into the rear line 35 to be proceeded by the RF unit and the DSP unit.

Figure 4:
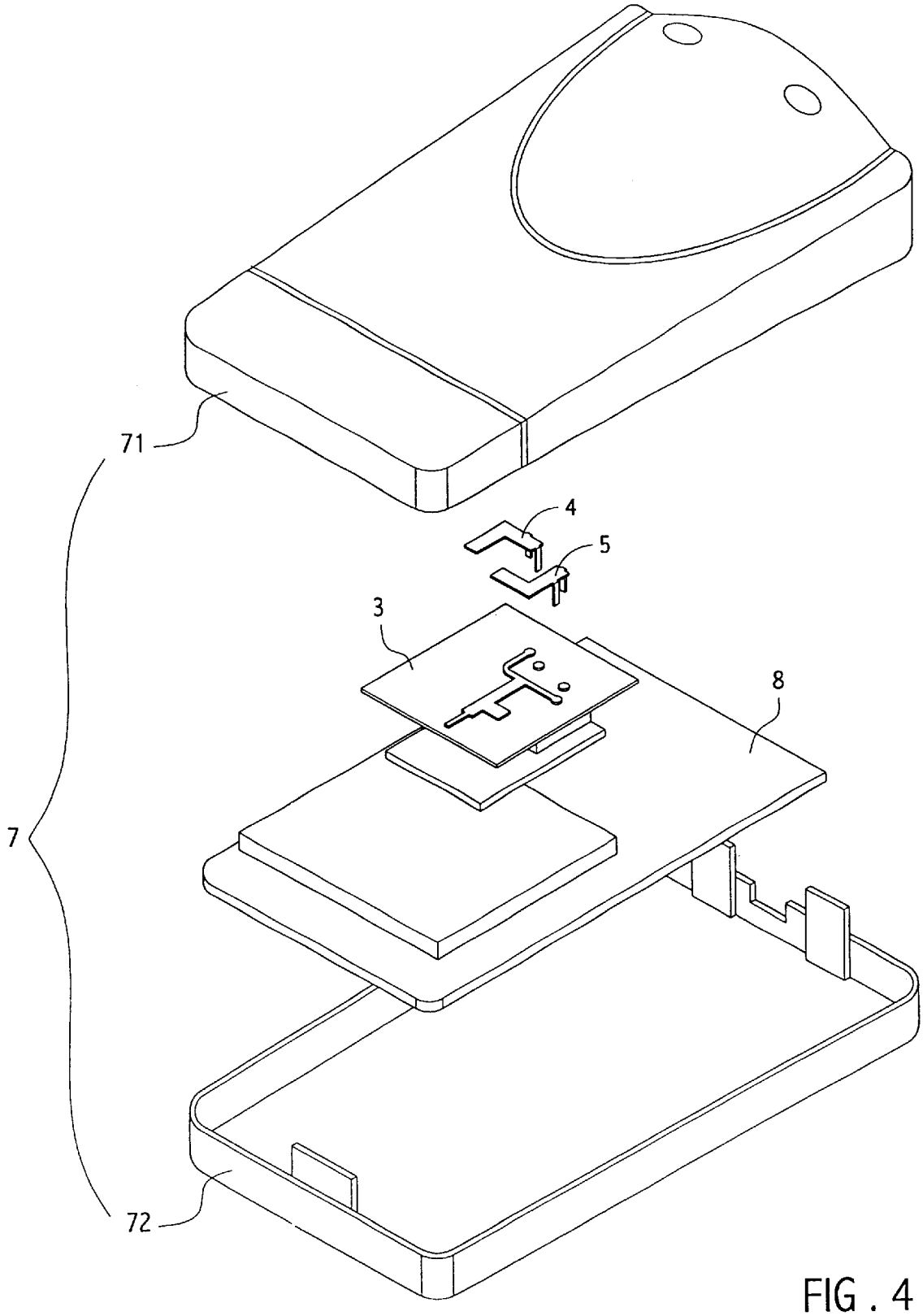
FIG. 4 shows a perspective view of the wireless network card of the present invention.

Referring to FIG. 4, the wireless network device comprises: a rectangle box 7, an antenna apparatus 7 having a matched circuit 3, a first antenna plate 4 and a second antenna plate 5, and a circuit board 8. The rectangle box 7 consists of an upper cover 71 and a lower cover 72 so that it protects the antenna apparatus 7 and the circuit board 8. The circuit board 8 comprises a RF unit and a DSP unit.

Figure 5A:
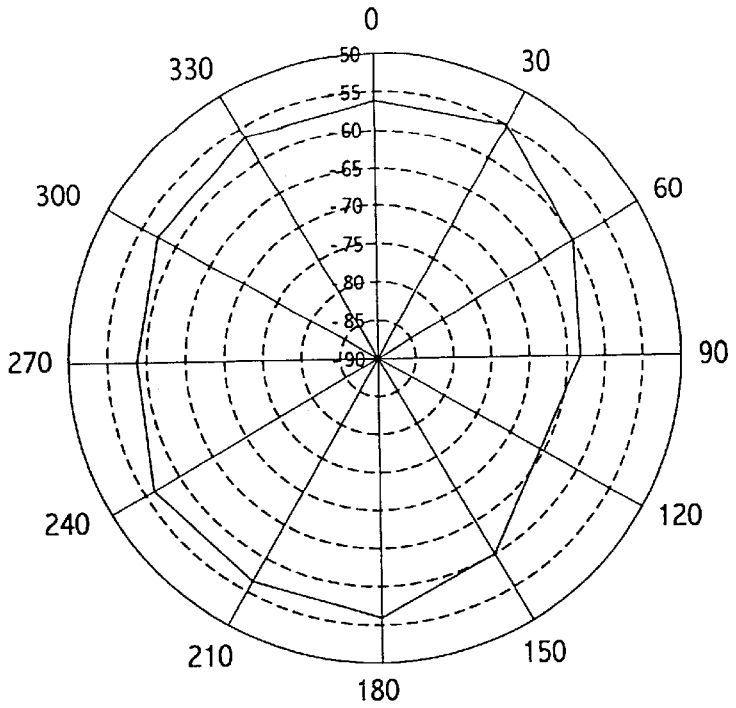
FIGS. 5A and 5B schematically depict the vertically and horizontally omni-directional radiation pattern of the antenna apparatus respectively in accordance with the preferred embodiment of the present invention.
Figure 5B:
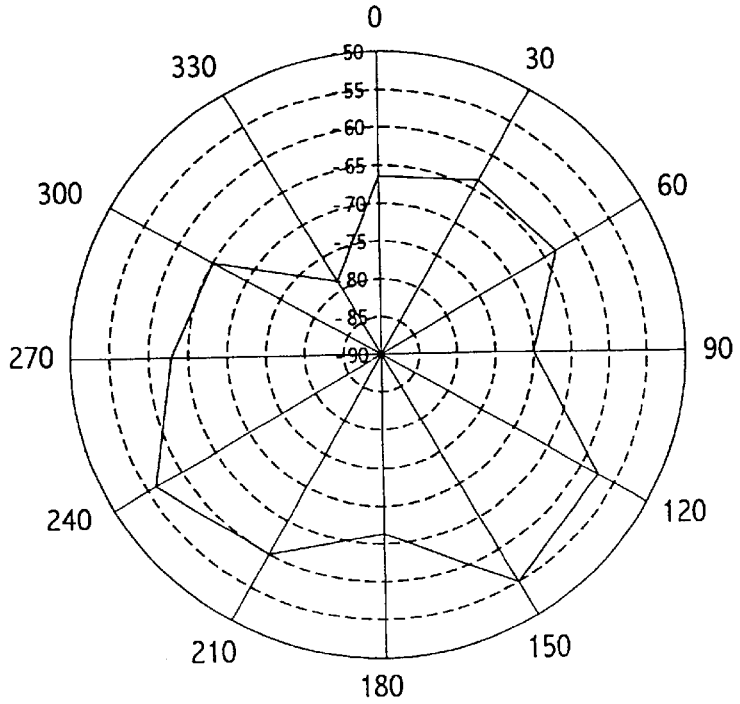

The first antenna plate 4 and the second antenna plate 5 are made of L shaped metal plates and are arranged symmetrically to form the like of an annulus rectangular so that a horizontally omni-directional radiation pattern can be accomplished. Furthermore, the antenna plates 4, 5 and the feet 41, 51 thereof form an inversed F shape and a specific height of the antenna apparatus can be maintained so that a vertically omni-directional radiation pattern can be accomplished. FIGS. 5A and 5B schematically depict the vertically and horizontally omni-directional radiation pattern of the antenna apparatus respectively in accordance with the present invention. As shown in the figure, the antenna apparatus of the present invention provides the vertically and horizontally omni-directional radiation pattern so as to improve the quality of the transmitted signal of the antenna.

Figure 6:
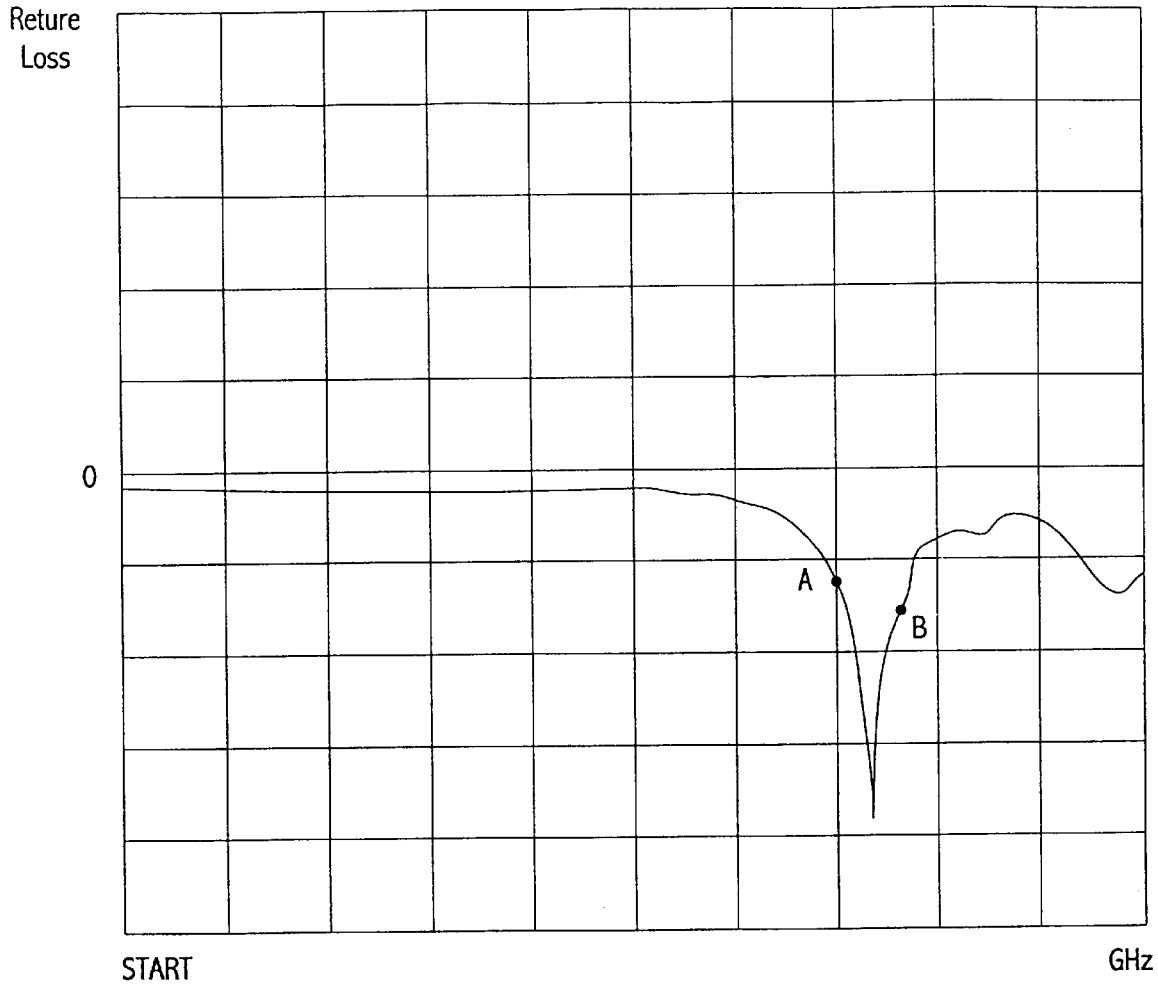
FIG. 6 shows the frequency spectrum of the return loss in accordance with the antenna apparatus of the present invention.

FIG. 6 shows the frequency spectrum of the return loss in accordance with the antenna apparatus of the present invention. Point A of the figure shows the return loss of the frequency at 2.4 GHz and point B of the figure shows the return loss of the frequency at 2.5 GHz. In general, if the value of the return loss is smaller, the possibility of the signal return loss when transmitting is smaller. For a wireless network, the bandwidth of the application is between 2.4 GHz and 2.5 GHz. As shown in FIG. 5, the maximum negative value of the return loss occurs in the antenna apparatus of the present invention. Thus, the perfect quality of the transmitted signal of the antenna apparatus is accomplished.

While the invention has been described with reference to various illustrative embodiments, the description is not intended to be construed in a limiting sense. Various modifications of the illustrative embodiments, as well as other embodiments of the invention, will be apparent to those persons skilled in the art upon reference to this description. It is therefore contemplated that the appended claims will cover any such modifications or embodiments as may fall within the scope of the invention defined by the following claims and their equivalents.

What is claimed is:

1. An antenna apparatus comprising:

a first antenna plate made of a metal plate, said first antenna plate having an electrical foot which is perpendicular to the metal plate and is connected to a circuit board;

a second antenna plate made of a metal plate, said second antenna plate having an electrical foot which is perpendicular to the metal plate and is connected to the circuit board; and, a matched circuit formed on the circuit board, said matched circuit having a front line and a transferring line with a first end formed thereon, said first end coupled to the front line so as to form a converging portion where a first feedback point and a second feedback point are installed on both sides of the converging portion for connecting said electrical feet respectively, wherein the first antenna plate and the second antenna plate are symmetrically arranged at the corresponding positions.

2. The antenna apparatus as claimed in claim 1, wherein said antenna plate further comprises a ground foot for connecting to the ground line of the circuit board and the side thereof shapes into an inversed F.

3. The antenna apparatus as claimed in claim 1, wherein said antenna plate is made of an L shaped metal plate and the first antenna plate and the second antenna plate are arranged as the like of an annulus rectangular.

4. The antenna apparatus as claimed in claim 1, wherein said converging portion is T shaped.

5. The antenna apparatus as claimed in claim 1, wherein the matched circuit forms an appropriate impedance between the first antenna plate and the second antenna plate and the impedance of the front line is about 50 ohms.

6. The antenna apparatus as claimed in claim 5, wherein the transferring line is a transformer and the impedance of the converging portion between the transformer and the. front line is about 50 ohms.

7. The antenna apparatus as claimed in claim 1, wherein a sub-line is installed on the transferring line for fine tuning the signal thereof.

8. The antenna apparatus as claimed in claim 1, wherein the length of the transferring line is a quarter of the wavelength.

9. The antenna apparatus as claimed in claim 1, wherein a second end of the transferring line is connected to a rear line for transmitting the signal into the circuit board.

10. The antenna apparatus as claimed in claim 1, wherein the circuit board comprises a RF unit and a DSP unit to proceed with the signal.

11. A wireless network device having an antenna apparatus, a RF unit and a DSP unit to proceed with the received signal, comprising:

a first antenna plate made of a metal plate, said first antenna plate having an electrical foot which is perpendicular to the metal plate and is connected to a circuit board;

a second antenna plate made of a metal plate, said second antenna plate having an electrical foot which is perpendicular to the metal plate and is connected to the circuit board; and, a matched circuit formed on the circuit board, said matched circuit having a front line and a transferring line with a first end formed thereon, said first end coupled to the front line so as to form a converging portion where a first feedback point and a second feedback point are installed on both sides of the converging portion for connecting said electrical feet respectively, wherein the first antenna plate and the second antenna plate are symmetrically arranged at the corresponding positions.

12. The wireless network device as claimed in claim 11, wherein said antenna plate further comprises a ground foot for connecting to the ground line of the circuit board and the side thereof shapes into an inversed F.

13. The wireless network device as claimed in claim 11, wherein said antenna plate is made of an L shaped metal plate and the first antenna plate and the second antenna plate are arranged as the like of an annulus rectangular.

14. The wireless network device as claimed in claim 11, wherein said converging portion is T shaped.

15. The wireless network device as claimed in claim 11, wherein the matched circuit forms an appropriate impedance between the first antenna plate and the second antenna plate and the impedance of the front line is about 50 ohms.

16. The wireless network device as claimed in claim 15, wherein the transferring line is a transformer and the impedance of the converging portion between the transformer and the front line is about 50 ohms.

17. The wireless network device as claimed in claim 11, wherein a sub-line is installed on the transferring line for fine tuning the signal thereof.

18. The wireless network device as claimed in claim 11, wherein the length of the transferring line is a quarter of the wavelength.

19. The wireless network device as claimed in claim 11, wherein a second end of the transferring line is connected to a rear line for transmitting the signal into the circuit board.

20. The wireless network device as claimed in claim 11, wherein the antenna apparatus and the circuit board are received within a rectangular box.

* * * * *